US005231387A

United States Patent [19]

Clerc

[11] Patent Number: 5,231,387

[45] Date of Patent: Jul. 27, 1993

[54] APPARATUS AND METHOD FOR ADDRESSING MICROTIP FLUORESCENT SCREEN

[75] Inventor: Jean-Frédéric Clerc, Machida, Japan

[73] Assignee: Commissariat A L'Energie Atomique, Paris, France

[21] Appl. No.: 789,765

[22] Filed: Nov. 8, 1991

Related U.S. Application Data

[63] Continuation of Ser. No. 371,267, Jun. 23, 1989, abandoned.

[30] Foreign Application Priority Data

Jun. 29, 1988 [FR] France ..... 88 08757

[51] Int. Cl.[5] ..... G09G 3/30

[52] U.S. Cl. ..... 340/781; 340/760

[58] Field of Search ..... 340/775, 781, 701, 702, 340/784, 760; 313/495, 496, 497, 409, 309; 315/169.2, 169.3

[56] References Cited

U.S. PATENT DOCUMENTS 4,575,765 3/1986 Hirt ..... 340/781
4,736,198 4/1988 Tokuyama et al. ..... 340/702
4,763,187 8/1988 Biberian ..... 340/775

FOREIGN PATENT DOCUMENTS 155895 9/1985 European Pat. Off. .
3036219 5/1982 Fed. Rep. of Germany .
2536889 6/1984 France .

OTHER PUBLICATIONS

"Flat Panel Displays and CRTs" Lawrence E. Tannas, Jr. 1985, pp. 21-22.

Displays Technology and Applications, vol. 8, No. 1, pp. 37-40, Jan. 1987, Guildford, J. Arrey (G.B.) G. Labrunie and R. Meyer.

*Primary Examiner*—Ulysses Weldon
*Assistant Examiner*—Doon Yup Chow
*Attorney, Agent, or Firm*—Michael N. Meller

[57] ABSTRACT

A microdot fluorescent screen having a reduced number of addressing circuits. This screen of N rows (16) is divided into k zones $Z_i$, each of the N/k rows (16) belonging to N/k families of rows. The k rows (16) of the same family are electrically interconnected. Each zone $Z_i$ also comprises three series of N/k conductive bands (26) each. The bands (26) of a first series are covered by a material (28) luminescing in the red, the bands (26) of a second series are covered by a material (29) luminescing in the green and the bands (26) of a third series are covered by a material (30) luminescing in the blue. Each triplet formed by three bands (26) covered by material luminescing in the red, green and blue is aligned substantially facing a row (16) (grid). The bands (26) of each series in a zone $Z_i$ are electrically interconnected for forming three anodes $A_{1,i}$, $A_{2,i}$ and $A_{3,i}$.

6 Claims, 7 Drawing Sheets

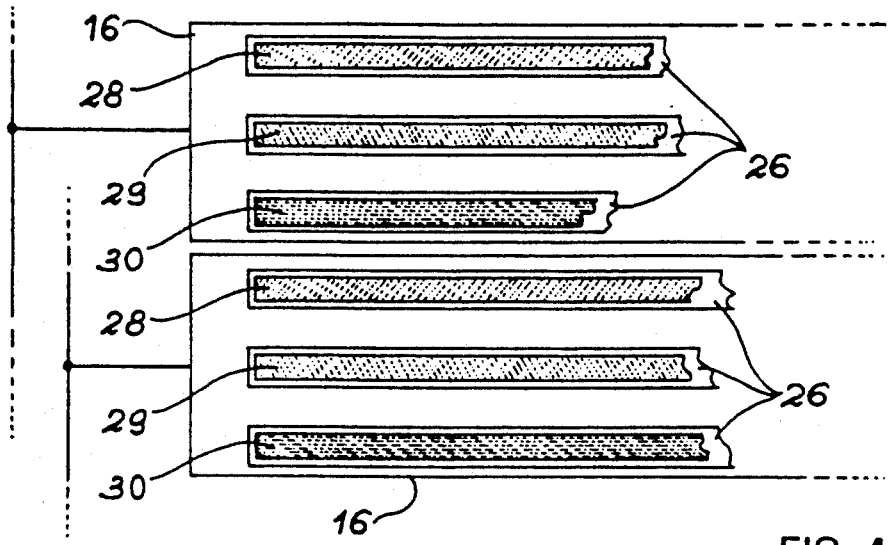
FIG. 4
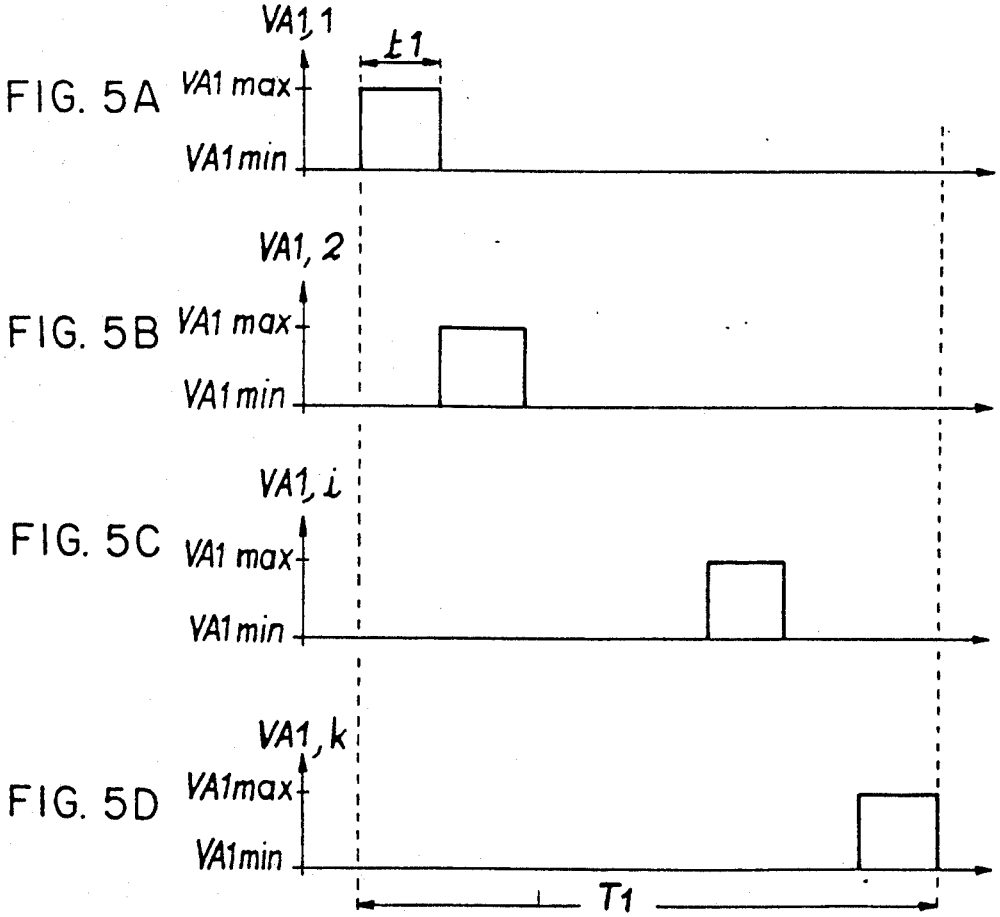

VA1,i
VA1 max
VA1 min
t1

VA2,i
VA2 max
VA2 min
t2

VA3,i
VA3 max
VA3 min
t3

VGj
VG max
VG min
t1
t2
t3
θ1
θ2
θ3

C1
VCℓ
VC max
VC min

C2
VCℓ
VC max
VCmin

C3
VCℓ
VC max
VC min
T1
T2
T3
T

VA1,i
t1
VA1max
VA1 min

VA2,i
t2
VA2max
VA2 min

VA3,i
t3
VA3max
VA3min

VG j
VG max
VG min
t

C4
VC ℓ
VC max
VC min

C5
VC ℓ
VC max
VCmin

C6
VC ℓ
VC max
VC min
t Z

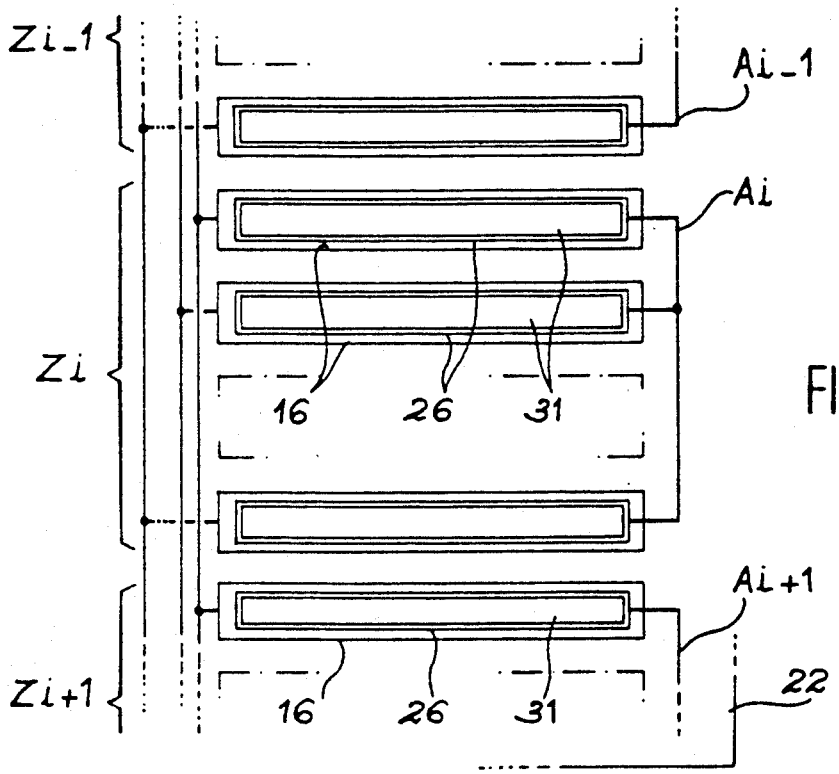
FIG 9
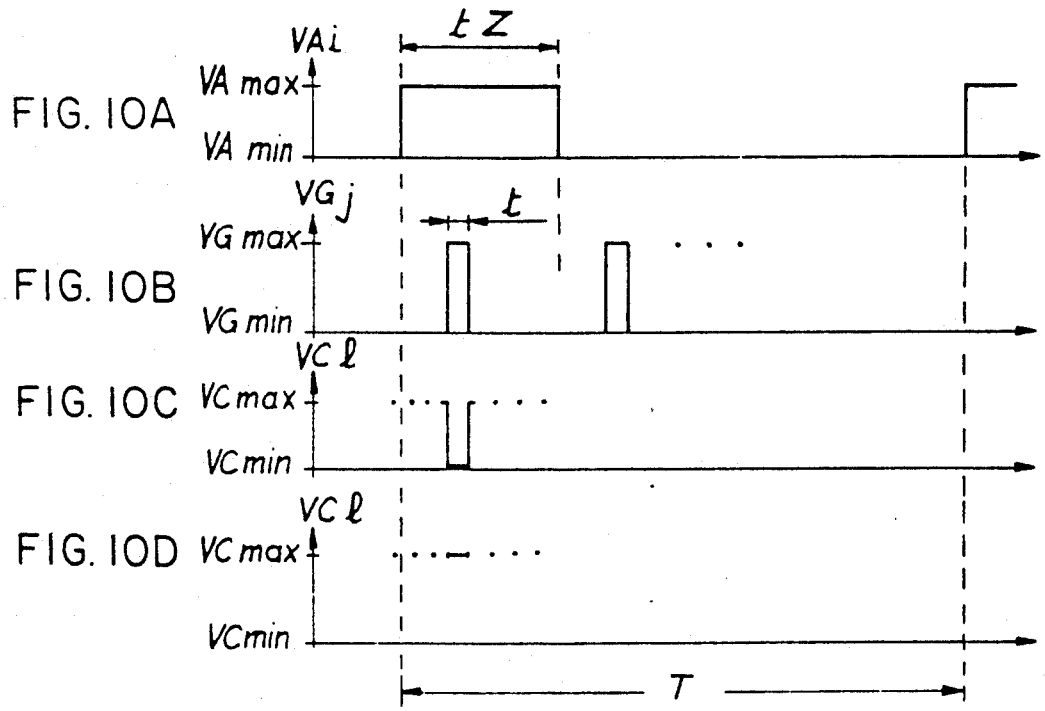

APPARATUS AND METHOD FOR ADDRESSING MICROTIP FLUORESCENT SCREEN

This application is a continuation of application Ser. No. 371,267, filed Jun. 23, 1989, now abandoned.

DESCRIPTION

The present invention relates to a microdot fluorescent screen having a reduced number of addressing circuits and to its addressing process. It applies more particularly to the display of fixed or moving images or pictures.

The known microtip fluorescent screens are monochromatic. A description thereof is given in the report of the "Japan Display 86 Congress", p.152 and in French patent application 84 11 986 of Jul. 27, 1984. The procedure used for monochromatic screens can be extrapolated to trichromatic screens.

FIG. 1 diagrammatically shows in perspective a matrix-type trichromatic screen, such as could be logically extrapolated from a monochromatic screen.

On a first e.g. glass substrate 10 are provided conductive columns 12 (cathode conductors of e.g. indium tin oxide) supporting metal, e.g. molybdenum microtips 14. The columns 12 intersect the perforated conductive rows 16 (grids) which are e.g. made of niobium.

All the microtips 14 positioned at an intersection of a row 16 and a conductive column 12 has its apex substantially facing a perforation of row 16. The cathode conductors 12 and grids 16 are separated by an e.g. silica insulating layer 18 provided with openings or apertures permitting the passage of the microtips 14.

A conductive material layer 20 (anode) is deposited on a second transparent, e.g. glass substrate 22. Parallel bands alternately in phosphors luminescing in red 24R, in green 24V and in blue 24B are deposited on the anode 20 facing the cathode conductors 12. The bands can be replaced by a mosaic pattern.

In this configuration, it is necessary to have a triplet of cathode conductors 12 (one facing a red band 24R, another facing a green band 24V and a third facing a blue band 24B), in order to bring about a color display along a screen column.

Each intersection of a grid 16 and a cathode conductor 12, in this embodiment, corresponds to a monochromatic pixel. A "color" pixel is composed by three monochromatic red, green and blue pixels. The combination of these three primary colors enables the viewer's eye to reconstitute a wide colored spectrum.

A screen of this type having N rows and M columns requires, in the color mode, N control circuits for the grids 16, 3M control circuits for the 3M cathode conductors 12, plus a circuit for the anode 20. For example a color display screen with 575 rows or lines and 720 columns (French color television standard) comprises 575 control circuits for the grids 16 and 2160 control circuits for the cathode conductors 12.

A microtip monochromatic fluorescent display screen 14 has 575 control circuits for grids 16 and 720 control circuits for the cathode conductors 12.

FIG. 2 shows a section of the microtip trichromatic fluorescent screen of FIG. 1. As there is only one anode 20, the electrons emitted by the microtips 14 of a pixel are directed either to the red 24R, green 24V or blue 24B phosphor. In particular, the lateral emission of a microtip 14 leads electrons intended for a red phosphor 24R, e.g. to a green phosphor 24V. This lateral emission also exists for monochromatic screens and leads to a resolution loss. For a trichromatic screen, said resolution loss is accompanied by a "dilution" of the colors, which is prejudicial to the viewing quality.

The objective of the present invention is to reduce the total number of control circuits of a microtip fluorescent screen, no matter whether it is of a trichromatic or a monochromatic type.

The invention also permits the autofocussing of the electrons emitted to the phosphor emitting in the desired color, which ensures a good color purity of the image or picture.

More specifically, the invention relates to the matrix display microtip fluorescent screen having a first insulating substrate on which are arranged in the two directions of the matrix, conductive columns (cathode conductors) supporting metal microtips and above the columns, N perforated conductive rows (grids), the rows and columns being separated by an insulating layer having apertures permitting the passage of the microtips, each intersection of a row and a column corresponding to a pixel, characterized in that it is subdivided into k zones $Z_i$, i ranging from 1 to k, with N/k successive rows each, the N rows of the screen being grouped into N/k families of rows, a zone $Z_i$ only having a single row of each family, the rows of the different families alternating within a zone $Z_i$, the rows of a same family being electrically interconnected and in that on a second transparent substrate facing the first, each zone $Z_i$ comprises a family of anodes covered by at least one luminescent material, the families of the different zones being electrically independent and identical, each family of one zone $Z_i$ facing N/k rows of the zone $Z_i$.

According to a first embodiment, with the screen according to the invention being trichromatic, each family of anodes of a zone $Z_i$ comprises three series of N/k conductive bands each, the bands of the different series alternately succeeding one another, the bands of one of the series being covered by a material luminescing in the red, the bands of another of said series being covered by a material luminescing in the green and the bands of the final series being covered by a material luminescing in the blue, each triplet formed by three bands respectively covered by materials luminescing in the red, green and blue being substantially aligned facing a row (grid), the bands of each series in a zone $Z_i$ being electrically interconnected for forming three anodes $A_{1,i}$, $A_{2,i}$ and $A_{3,i}$.

The system of electrodes and grids forms N/k combs with k teeth along the rows of the screen. Each comb corresponds to one of the N/k families of rows.

The anodes are also in the form of combs. For a trichromatic screen, a zone $Z_i$ comprises three combs-anodes, one for each of the primary colors red, green and blue. The teeth of these combs are aligned on the grids of the screen. The width thereof is substantially less than one third of the width of a grid and in this way one tooth of each comb can face a grid.

The invention also makes it possible to produce a monochromatic screen. In this case, on the second transparent substrate, each family of anodes of a zone $Z_i$ comprises a series of conductive strips covered by a luminescent material, each conductive strip being substantially aligned facing a row (grid), the conductive strips of a zone $Z_i$ being electrically interconnected to form an anode $A_i$.

The invention also relates to a process for addressing said screen.

According to a first process for addressing a screen according to the invention, the display of a trichromatic frame takes place during a frame time T. The following operations are carried out for the anodes $A_{1,i}$, i ranging between 1 and k and which are of a successive nature. These operations are then repeated for anodes $A_{2,i}$ and $A_{3,i}$ so as to display for a frame time T three monochromatic images in the three primary colors red, green and blue. These operations consist of:

successively raising each of the anodes $A_{1,i}$, (respectively $A_{2,i}$, $A_{3,i}$) of the zone $Z_i$, i ranging between 1 and k, to a potential $V_{A1max}$ (respectively $V_{A2max}$, $V_{A3max}$) adequate for attracting the electrons possibly emitted by the microtips with an energy higher than the threshold cathodoluminescence threshold of the corresponding luminescent material for an addressing time $t_1$ (respectively $t_2$, $t_3$) periodically at a period corresponding to a frame time T, such that $T=k(t_1+t_2+t_3)$, when the anodes $A_{1,i}$ (respectively $A_{2,i}$, $A_{3,i}$) are not raised to the potential $V_{A1max}$ (respectively $V_{A2max}$, $V_{A3max}$, the anodes $A_{1,i}$ (respectively $A_{2,i}$, $A_{3,i}$) are raised to a potential $V_{A1min}$ (respectively $V_{A2min}$, $V_{A3min}$), such that the electrons emitted by the microtips are repelled or have an energy below the cathodoluminescence threshold energy of the corresponding luminescent material;

for the addressing time $t_1$ (respectively $t_2$, $t_3$) of each anode $A_{1,i}$ (respectively $A_{2,i}$, $A_{3,i}$), successively raising the different families of rows to a potential $V_{Gmax}$ for a row selection time $\theta_1$ (respectively $\theta_2$, $\theta_3$), such that $T=N(\theta_1+\theta_2+\theta_3)$, when they are not raised to the potential $V_{Gmax}$, the different families of rows are raised to a potential $V_{Gmin}$, such that the microtips emit no electrons; and during the row selection time $\theta_1$ (respectively $\theta_2$, $\theta_3$) of each row of each zone $Z_i$, addressing the cathode conductors in such a way as to "illuminate" the pixels of the row which should be illuminated.

According to a second process for addressing a screen according to the invention for the display of a trichromatic frame of the image produced during a frame time T, the following operations are performed successively for each of the zones $Z_i$, i ranging from 1 to k:

successively raising the families of rows to a potential $V_{Gmax}$ for the row selection time t, such that $t=T/N$, when they are not raised to the potential $V_{Gmax}$, the families of rows are raised to the potential $V_{Gmin}$, such that the microtips do not emit electrons; during the selection time t of each row of the zone $Z_i$ in question, successively raising the anodes $A_{1,i}$, $A_{2,i}$ and $A_{3,i}$, respectively to potentials $V_{A1max}$, $V_{A2max}$ and $V_{A3max}$, which are adequate for attracting the electrons optionally emitted by the microtips with an energy higher than the threshold cathodoluminescence energy of the corresponding luminescent materials, during addressing times respectively $t_1$, $t_2$ and $t_3$, such that $t_1+t_2+t_3=t$, when they are not raised to the potentials $V_{A1max}$, $V_{A2max}$ and $V_{A3max}$, the anodes $A_{1,i}$, $A_{2,i}$ and $A_{3,i}$ are raised to the potentials $V_{A1min}$, $V_{A2min}$ and $V_{A3min}$ respectively, such that the electrons emitted by the microtips are repelled or have an energy below the threshold cathodoluminescence energy of the corresponding luminescent material; and during the addressing times $t_1$, $t_2$ and $t_3$ of each anode $A_{1,i}$, $A_{2,i}$ and $A_{3,i}$, addressing the cathode conductors so as to "illuminate" the pixels of the row which should be illuminated.

For each process and at a given instant, a single family of rows and a single anode of a zone are selected. The emission of the electrons is localized on the overlap surface of the grid and selected anode. This emission is modulated by the potential applied to the cathode conductors, which function in accordance with the prior art. The electrons are repelled by the unselected anodes and drop onto the grid. They are then eliminated, or have an energy below the threshold cathodoluminescence energy of the corresponding luminescent materials and are also eliminated.

The screen is addressed sequentially with a reduced number of control circuits. The number of families of rows added to the number of anodes (three per zone and k zones) remains well below the number of rows or lines of the screen.

At each instant, the electrons emitted by the microtip are focussed on the anode of the selected color, thus guaranteeing a color purity not reduced by the phenomena of the lateral emission of electrons from the microtips.

In these embodiments of the addressing process, the three primary colors of the screen are never displayed at the same time. The color sensation on a broad spectrum perceived by a screen viewer is due to the reconstitution of the colored spectrum by the viewer's eye. The eye is a "slow" detector compared with the different characteristic display times of the screen (frame time T, etc.) and the perception of the full color is due to an averaging effect on several frames of the picture.

For a monochromatic screen, an addressing process consists of carrying out the following operations for displaying one frame of the screen, said display taking place during a frame time T: successively raising each of the anodes $A_i$, i ranging between 1 and k, to a potential $V_{Amax}$ for an addressing time $t_Z$, such that $T=kt_Z$, when they are not raised to an adequate potential $V_{Amax}$ for attracting the electrons possibly emitted by the microtips, the anodes $A_i$ are raised to a potential $V_{Amin}$, such that the electrons emitted by the microtips are repelled, or have an energy below the threshold cathodoluminescence energy of the luminescent material;

during the addressing time $t_Z$ of each anode $A_i$, successively raising each family of rows to a potential $V_{Gmax}$ for a row selection time t, such that $t=T/N$, when they are not raised to the potential $V_{Gmax}$, the families of rows are raised to a potential $V_{Gmin}$, such that the microtips do not emit electrons; and during the row selection time t of each family of rows, addressing the cathode conductors in such a way as to "illuminate" the pixels of each row which should be illuminated.

The characteristics and advantages of the invention can be better gathered from the following non-limitative description with reference to the attached drawings, wherein:

FIG. 1, already described, shows diagrammatically a microtip fluorescent trichromatic screen such as could be extrapolated.

FIG. 2, already described, shows diagrammatically a section of a microtip fluorescent trichromatic screen, such as could be extrapolated in accordance with FIG. 1.

FIG. 3A shows diagrammatically a portion of a trichromatic screen according to the invention, FIG. 3B showing a section along axis aa' of said screen.

FIG. 4, on a larger scale than in FIG. 3, shows diagrammatically and partially two successive rows of a trichromatic screen according to the invention.

FIG. 5 shows diagrammatically the timing diagrams relating to the addressing of one of the three anode series according to a first process for addressing a trichromatic screen according to the invention.

FIG. 9 shows diagrammatically part of a microtip fluorescent monochromatic screen according to the invention.

FIGS. 10A–10D show diagrammatically the timing diagrams relating to a process for addressing a pixel of a monochromatic screen according to the invention.

Figure 3B:
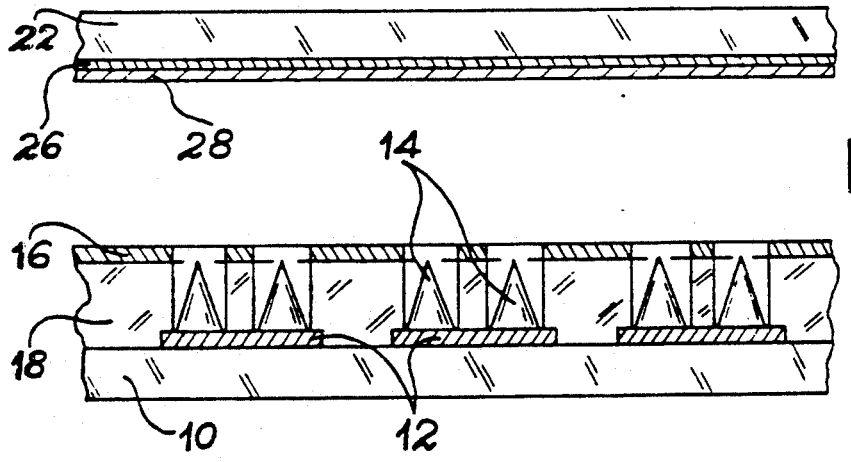
Figure 3A:
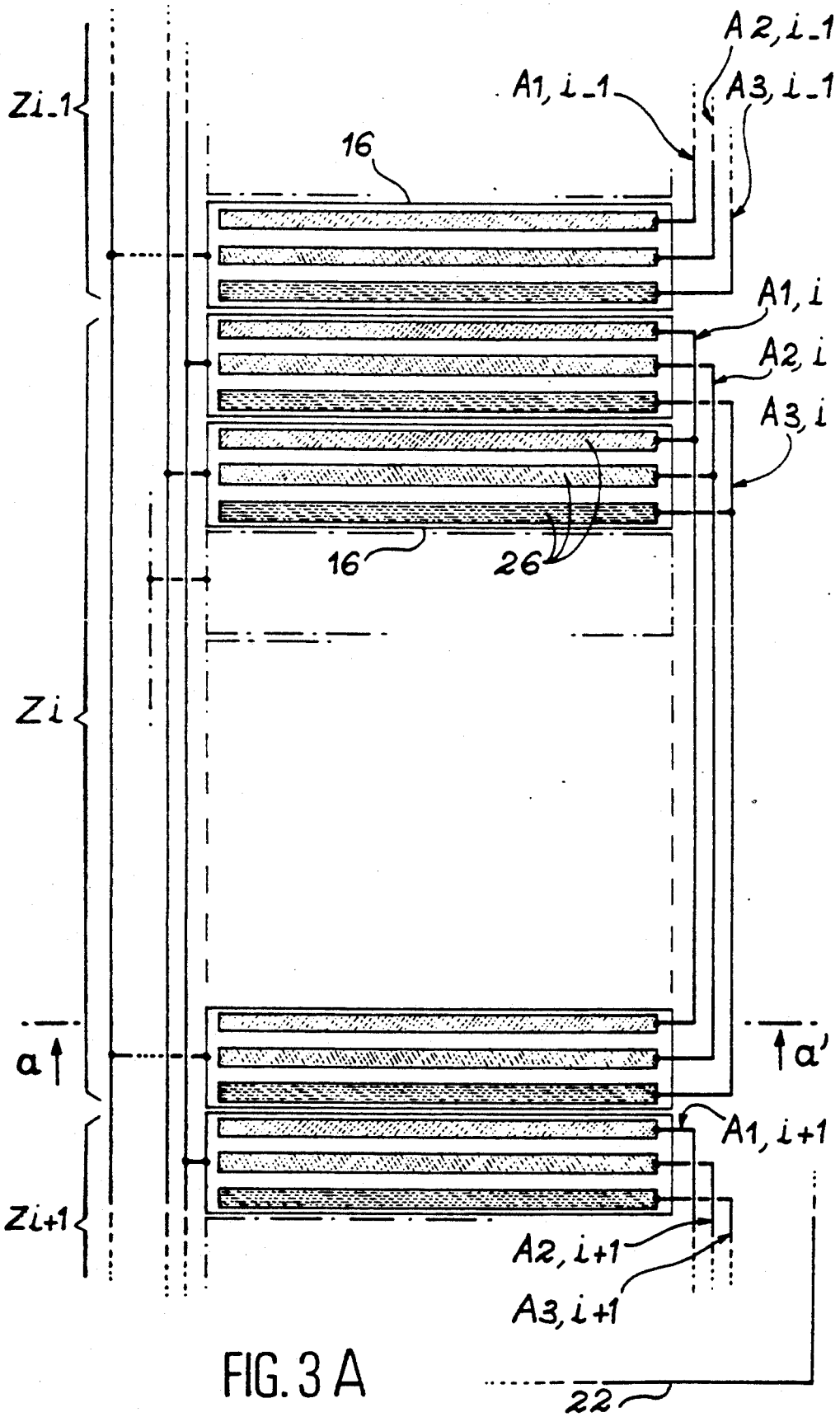
Figures 6A, 6B, 6C, 6D, 6E, 6F, 6G:
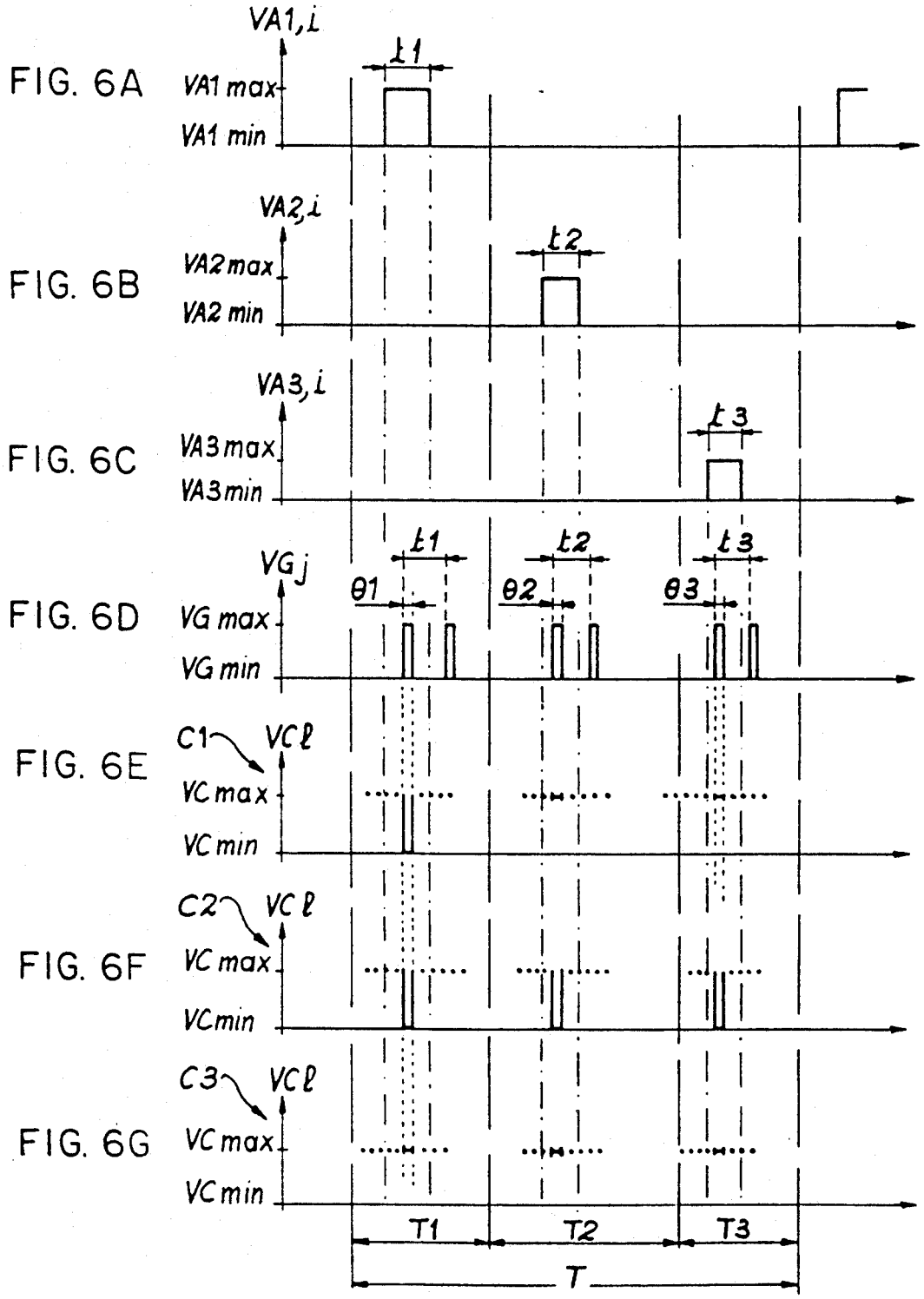
FIGS. 6A–6G show diagrammatically the timing diagrams relating to the first process for addressing a pixel of a trichromatic screen according to the invention.
Figures 7A, 7B, 7C, 7D:
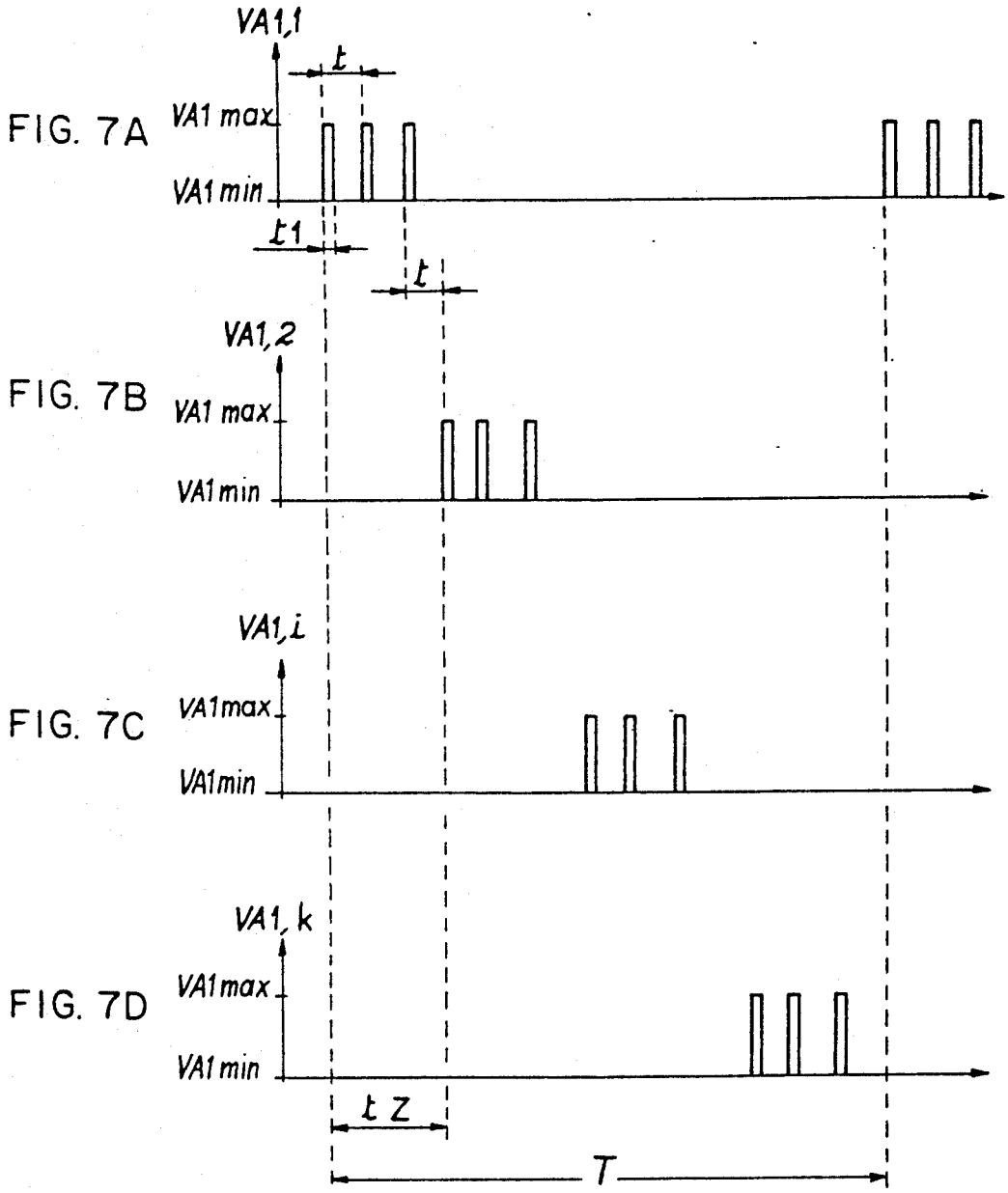
FIGS. 7A–7D show diagrammatically the timing diagrams relating to the addressing of one of the three series of anodes according to a second process for addressing a trichromatic screen according to the invention.
Figures 8A, 8B, 8C, 8D, 8E, 8F, 8G:
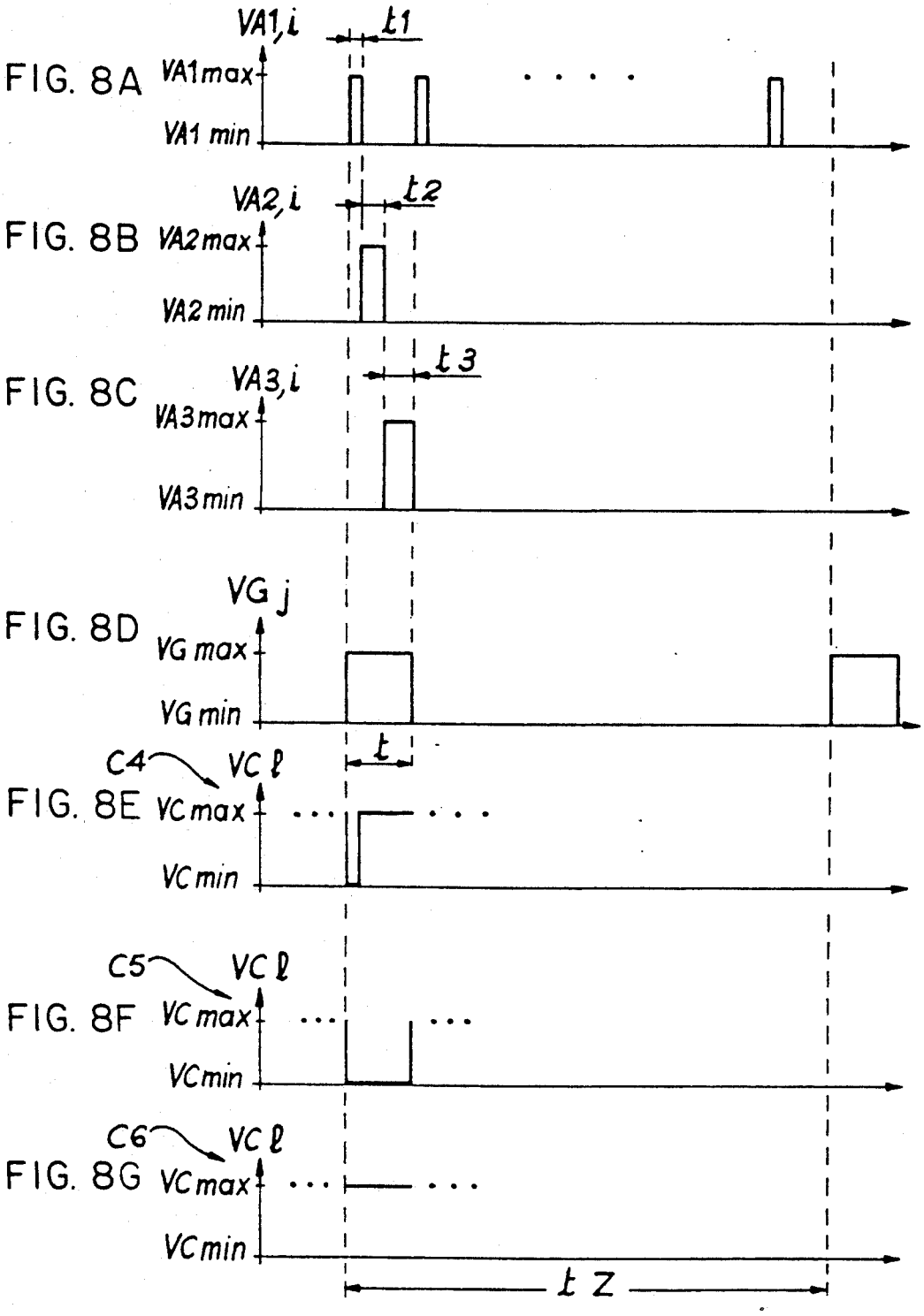
FIGS. 8A–8G show diagrammatically the timing diagrams relating to the second process for addressing a pixel of a trichromatic screen according to the invention.

FIG. 3A diagrammatically shows a portion of a trichromatic screen according to the invention. The screen is viewed through the diagrammatically represented second transparent substrate 22. The screen is subdivided into k zones $Z_i$, i ranging between 1 and k, three of these $Z_{i-1}$, $Z_i$ and $Z_{i+1}$ being at least partly visible in FIG. 3A. 3N parallel conductive bands 26, N being the number of rows or lines of the screen, rest on substrate 22. These bands 26 are e.g. made of indium tin oxide. These conductive bands 26 are grouped and electrically interconnected in order to form three series of N/k bands each per zone Zi, corresponding to three anodes $A_{1,i}$, $A_{2,i}$ and $A_{3,i}$. Each of the bands 26 is covered by a luminescent material. FIG. 3B diagrammatically shows a section of the trichromatic screen according to the invention. This section is along axis aa' shown in FIG. 3A. On the first e.g. glass substrate 10, the elements are the same and are arranged in the same way as in the prior art. The cathode conductors 12 are aligned in accordance with the screen columns. These cathode conductors 12 support microtips 14. The grids 16 along the rows of the screen intersect the cathode conductors 12. The grids 16 (rows) and cathode conductors 12 (columns) are separated by an insulating layer 18 having apertures permitting the passage of the microtips.

The second transparent, insulating and e.g. glass substrate 22 supports the conductive bands 26 aligned on grids 16 and therefore aligned in accordance with the rows of the screen. These conductive bands 26 are covered with luminescent material. Along the axis aa', the band 26 shown in FIG. 3B is covered with a material 28, e.g. luminescing in the red.

As can be seen in FIG. 4, a first series of such bands 26 is covered by a material 28 luminescing in the red, e.g. Eu-doped $Y_2O_2S$ and forms an anode $A_{1,i}$, e.g. for zone $Z_i$, a second series of said bands is covered by a material 29 luminescing in the green, e.g. CuAl-doped ZnS and forms an anode $A_{2,i}$, e.g. for zone $Z_i$, and the third series of bands 26 is covered by a material 30 luminescing in the blue, e.g. Ag-doped ZnS and forms an anode $A_{3,i}$, e.g. for zone $Z_i$. The bands 26 of the different series alternate and are equidistant.

Each triplet formed by an anode of each series faces a grid 16 (row). The grids 16 rest on a second substrate 10 (not shown in FIGS. 3A and 4). The grids 16 intersect cathode conductors 12 (not shown in FIGS. 3A and 4). Grids 16 and cathode conductors 12 are separated by an insulating layer 18 (not shown in FIGS. 3A and 4). Each intersection of a grid 16 and a cathode conductor 12 forms a trichromatic pixel.

The grids 16 (along the rows) of the screen are grouped into N/k families. One zone $Z_i$ of the screen has a single grid 16 of each family. The grids 16 of the different families alternate within a zone Zi and the grids 16 of the same family are electrically interconnected.

First Example of the Process for Addressing a Microtip Fluorescent Trichromatic Screen According to the Invention (FIGS. 5 AND 6A–6G)

This process consists of dividing the display time of a frame T into three:

a subframe time $T_1$ corresponds to the display of a first frame, e.g. red, of the screen, a subframe time $T_2$ corresponds to the display of a second frame, e.g. green, of the screen, a subframe time $T_3$ corresponds to the display of a third frame, e.g. blue, of the screen, $T_1+T_2+T_3$ being connected by the relation $T_1+T_2+T_3=T$.

The red, green and blue frames of the picture are successively displayed.

As can be seen in FIG. 5 within the subframe time $T_1$($T_2$, $T_3$) respectively), during which is displayed the red frame (green, blue respectively) of the screen, the k anodes of the zones $Z_1, \ldots, Z_k$ correspond to red (respectively green, blue), designated $A_{1,i}$ (respectively $A_{2,i}$, $A_{3,i}$) are successively addressed. This addressing consists of raising each anode $A_{1,i}$ (respectively $A_{2,i}$, $A_{3,i}$) successively to a potential $V_{A1max}$ (respectively $V_{A2max}$, $V_{A3max}$) during a time $t_1$ (respectively $t_2$, $t_3$). This potential $V_{A1max}$ (respectively $V_{A2max}$, $V_{A3max}$) is adequate for attracting the electrons optionally emitted by the microtips with an energy higher than the threshold cathodoluminescence energy of the material 28 (respectively 29, 30) luminescing in the red (or green or blue). Outside the addressing time $t_1$, the anodes $A_{1,i}$ (respectively $A_{2,i}$ and $A_{3,i}$) are raised to a potential $V_{A1min}$ (respectively $V_{A2min}$, $V_{A3min}$), such that the electrons emitted by the microtips are repelled and eliminated by means of a grid 16, or have an energy below the threshold cathodoluminescence energy of the luminescent material corresponding thereto and are also eliminated.

The subframe time $T_1$ (respectively $T_2$, $T_3$) is linked with the addressing time $t_1$ (respectively $t_2$, $t_3$) of an anode $A_{1,i}$ (respectively $A_{2,i}$, $A_{3,i}$) by the relation: $T_1=kt_1$ (respectively $T_2=kt_2$, $T_3=kt_3$).

The frame times $T_1$, $T_2$ and $T_3$ and the values of the addressing potentials of the anodes are experimentally adjusted as a function of the luminescent materials 28, 29 and 30, so as to obtain a pure white when all the screen is addressed.

FIGS. 6A–6G diagrammatically shows the timing diagrams relating to the first process for addressing a pixel of a trichromatic screen according to the invention.

The display of a trichromatic frame of the screen takes place in a frame time T subdivided into three subframe times $T_1$, $T_2$ and $T_3$ corresponding to the respective display of a red, green and blue frame.

FIGS. 6A-6G only shows the addressing of the anodes $A_{1,i}$, $A_{2,i}$ and $A_{3,i}$ of zone $Z_i$. These addressing operations take place during respective addressing periods $t_1$, $t_2$ and $t_3$, the first being within the red frame, the second within the green frame and the third within the blue frame.

The grids 16 are addressed by families. The pixels involved in each addressing of a family of rows are those corresponding to the superimposing of a row of the addressed family with the selected anode.

The families of rows $G_j$, j ranging between 1 and N/k, are raised to a potential $V_{Gj}$. $V_{Gj}$ assumes a value $V_{Gmax}$ for the row selection times $\theta_1$, periodically at period $t_1$, for the entire frame time $T_1$, then $V_{Gj}$ assumes the value $V_{Gmax}$ for the row selection time $\theta_2$, periodically at period $t_2$, throughout the frame time $T_2$ and then $V_{Gj}$ assumes the value $V_{Gmax}$ for a row selection time $\theta_3$, periodically at period $t_3$, for the entire frame time $T_3$. Outside the row selection times, $V_{Gj}$ assumes the value $V_{Gmin}$ permitting no electron emission by microdots 14.

The addressing times $t_1$, $t_2$ and $t_3$ are linked with the row selection times $\theta_1$, $\theta_2$ and $\theta_3$ by the relations: $t_1/\theta_1=t_2/\theta_2=t_3/\theta_3=N/k$.

The "illumination" of the pixels positioned on the row of family $G_j$ facing the anodes of zone $Z_i$ is controlled by the potential applied to the cathode conductors 12.

The three timing diagrams C1, C2 and C3 of FIGS. 6A-6G represent the control signals $V_{Cl}$ of the cathode conductor 12 of number l in the matrix making it possible to "illuminate" the pixel corresponding to the intersection of the row of family $G_j$ in zone $Z_i$ with the cathode conductor 12 of number l, said pixel being ijl.

Timing diagram C1: pixel ijl "illuminated" in red

To illuminate the pixel ijl in red, the control potential $V_{Cl}$ of cathode conductor 12 of number l assumes a value $V_{Cmin}$ during the selection time $\theta_1$ of the row of family $G_j$ in zone $Z_i$. The potential difference $V_{Gmax}-V_{Cmin}$ permits the emission of electrons by microdots 14. Pixel ijl is extinguished in the two other colors, because the potential $V_{Cl}$ then assumes the value $V_{Cmax}$ not permitting the emission of electrons by the microdots 14 during selection times $\theta_2$ and $\theta_3$ of the row of family $G_j$.

Timing diagram C2: Pixel ijl "illuminated" in the three primary colors red, green and blue=pixel ijl "white"

For each selection of the row corresponding to pixel ijl, the potential $V_{Cl}$ assumes the value $V_{Cmin}$. Pixel ijl successively assumes the colors red, green and blue, the white color being restored by the persistence of vision of a viewer's eye.

Timing diagram C3: Pixel ijl "extinguished", pixel ijl "black"

For each selection of the row corresponding to pixel ijl, potential $V_{Cl}$ is maintained at the value $V_{Cmax}$, no color being "illuminated".

An example of numerical data corresponding to the first process for addressing a trichromatic screen according to the invention is as follows:

N: number of rows 500
k: number of zones 20
T: frame time 20 ms
$T_1$: red frame time 5 ms
$T_2$: green frame time 5 ms
$T_3$: blue frame time 10 ms
$t_1$: addressing time of a red anode in a zone, 5 ms/20=0.25 ms
$t_2$: addressing time of a green anode in a zone, 5 ms/20=0.25 ms
$t_3$: addressing time of a blue anode in a zone, 10 ms/20=0.5 ms
$\theta_1$: selection time of a family of rows during the addressing of a red anode 0.25 ms/25=10 μs
$\theta_2$: selection time of a family of rows during the addressing of a green anode 10 μs
$\theta_3$: selection time of a family of rows during the addressing of a blue anode 20 μs
$V_{A1}$: addressing potential of anodes $A_{1,i}$: $V_{A1min}=40$ V, $V_{A1max}=100$ V
$V_{A2}$: addressing potential of anodes $A_{2,i}$: $V_{A2min}=40$ V, $V_{A2max}=100$ V
$V_{A3}$: addressing potential of anodes $A_{3,i}$: $V_{A3min}=40$ V, $V_{A3max}=150$ V
$V_{Gj}$: addressing potential of a family of rows: $V_{Gmin}=-40$ V, $V_{Gmax}=40$ V
$V_{Cl}$: control potential of column l: $V_{Cmin}=-40$ V, $V_{Cmax}=0$ V.

Second Example of Process for Addressing a Microtip Fluorescent Trichromatic Screen According to the Invention (FIGS. 7A-7D and 8A-8G)

This process consists of the row by row addressing of the three primary colors for each pixel.

FIGS. 7A-7D show the addressing sequences of anodes $A_{1,i}$, . . . $A_{1,k}$ of zones $Z_1$ to $Z_k$ respectively. Anodes $A_{1,i}$, $A_{2,i}$ and $A_{3,i}$, i ranging between 1 and k, are successively addressed. The display frame time T is subdivided into zone times $t_Z$ during which all the rows of one zone are addressed. The frame time T and the zone time $t_Z$ are linked by the relation $T=kt_Z$.

Each anode $A_{1,i}$ (respectively $A_{2,i}$, $A_{3,i}$) is addressed for an addressing time $t_1$ (respectively $t_2$, $t_3$), for the zone time $t_Z$ and at the period of a frame time T.

During the zone time $t_Z$, an anode $A_{1,i}$ (respectively $A_{2,i}$, $A_{3,i}$) is periodically raised during an addressing time $t_1$ (respectively $t_2$, $t_3$) to a potential $V_{A1max}$ (respectively $V_{A2max}$, $V_{A3max}$) adequate for attracting the electrons emitted by the microtips 14 with an energy exceeding the threshold cathodoluminescence energy of the material 28 (respectively 29, 30). The period is in this case t the selection time of a row in a zone. Thus, the zone time is linked with the row selection time t by the relation $t_Z=(N/k)t$.

The addressing times $t_1$, $t_2$ and $t_3$ of the anodes $A_{1,i}$, $A_{2,i}$ and $A_{3,i}$ respectively are linked with the row selection times t by the relation $t_1+t_2+t_3=t$.

Outside the addressing times, the anodes $A_{1,i}$ (respectively $A_{2,i}$, $A_{3,i}$) are raised to a potential $V_{A1min}$ (respectively $V_{A2min}$, $V_{A3min}$) such that the electrons emitted by the microtips 14 are rejected towards the grids 16 and eliminated or have an energy below the threshold cathodoluminescence energy of the luminescent material corresponding thereto and are also eliminated.

FIGS. 8A-8G diagrammatically show the timing diagrams relating to the second process for addressing a pixel of a trichromatic screen according to the invention.

The displaying of a trichromatic frame of the screen takes place in a frame time T, which is subdivided into zone times $t_Z$. In a zone time $t_Z$, all the rows of a zone are successively addressed.

The timing diagrams of FIGS. 8A-8G represent the addressing of the pixel ijl. The families of rows $G_j$, j ranging between 1 and N/k, are successively raised to a potential $V_{Gmax}$. $V_{Gj}$ assumes a value $V_{Gmax}$ during the row selection time t at period $t_Z$. During the row selection time t, the three anodes $A_{1,i}$, $A_{2,i}$, $A_{3,i}$ of zone $Z_i$ are consequently successively addressed during the respective addressing times $t_1$, $t_2$ and $t_3$.

The "illumination" of the pixels positioned on the row of family $G_j$ facing the anodes of zone $Z_i$ is controlled by the potential applied to the cathode conductors 12.

The three timing diagrams C4, C5 and C6 of FIGS. 8A–8G show the control signals $V_{Cl}$ of the cathode conductor 12 of number l making it possible to "illuminate" the pixel ijl.

Timing diagram C4: Pixel ijl "illuminated" in red

In order to "illuminate" the selected pixel ijl in red, the control potential $V_{Cl}$ of the cathode conductor 12 of number l assumes the value $V_{Cmin}$ during the addressing time $t_1$ of anode $A_{1,i}$. $V_{Cl}$ is kept at value $V_{Cmax}$ for the addressing times $t_2$ and $t_3$ of anodes $A_{2,i}$ and $A_{3,i}$ (corresponding to green and blue).

Timing diagram C5: Pixel ijl "illuminated" in the three primary colors red, green and blue=pixel ijl "white"

The potential $V_{Cl}$ is maintained at the value $V_{Cmin}$ for the entire row selection time, which permits the emission of the electrons by the microtips 14 during each addressing time $t_1$, $t_2$ and $t_3$ of anodes $A_{1,i}$, $A_{2,i}$ and $A_{3,i}$.

Timing diagram C6: Pixel ijl "extinguished", pixel ijl "black"

On this occasion the potential $V_{Cl}$ is maintained during the row selection time at value $V_{Cmax}$ not permitting the emission of electrons, so that the pixel ijl is "black".

An example of numerical data corresponding to the second process for addressing a trichromatic screen according to the invention is as follows:

N: number of rows 500
k: number of zones 20
T: frame time 20 ms
$t_Z$: zone time 1 ms
$t_l$: row selection time 1 ms/25=40 μs
$t^1$: addressing time of an anode A1,i=10 μs
$t_2$: addressing time of an anode $A_{2,i}$=10 μs
$t_3$: addressing time of an anode $A_{3,i}$=20 μs
$V^{A1}$: addressing potential of anodes $A_{1,i}$: $V_{Almin}$=40 V, $V_{a1max}$=100 V
$V_{A2}$: addressing potential of anodes $A_{2,i}$: $V_{A2min}$=40 V, $V_{A2max}$=100 V
$V_{A3}$: addressing potential of anodes $A_{3,i}$: $V_{A3min}$=40 V, $V_{A3max}$=150 V
$V_{Gj}$: addressing potential of a family of rows $V_{Gmin}$=−40 V, $V_{Gmax}$=+40 V
$V_{Cl}$: control potential of column l: $V_{Cmin}$=−40 V, $V_{Cmax}$=0 V.

Figure 1:
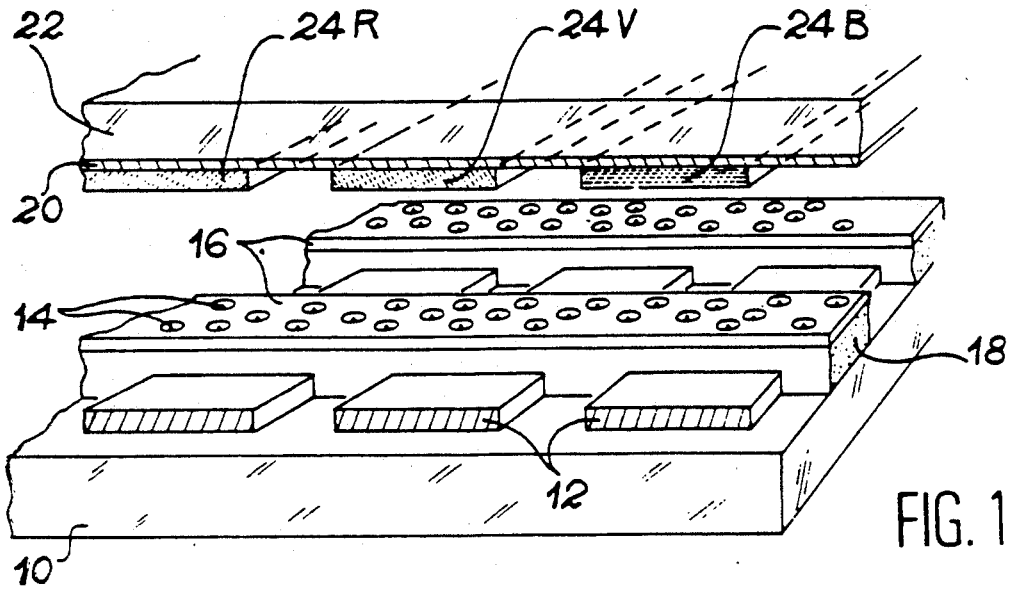
Figure 2:
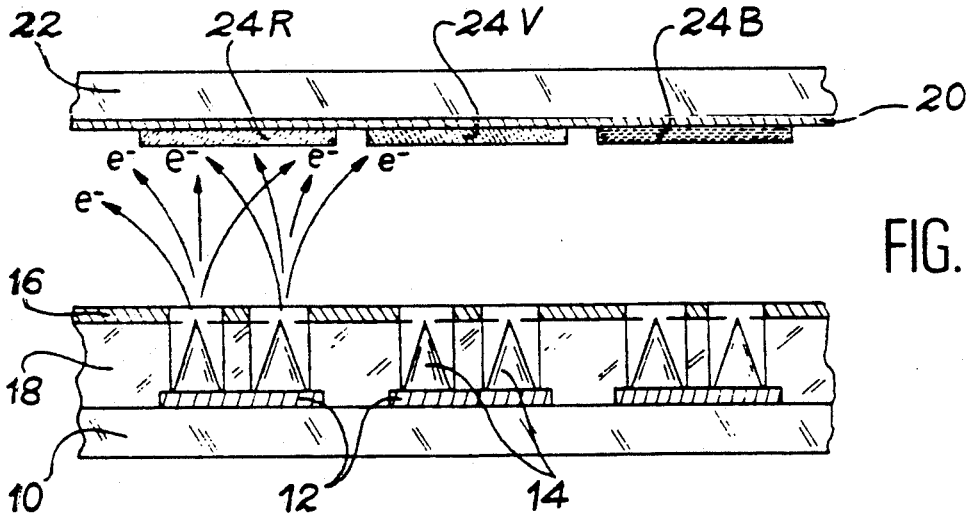

A microtip fluorescent trichromatic screen according to the invention with 575 rows and 720 columns (French television standard) can operate with 23 families of rows, 25 red anodes, 25 green anodes, 25 blue anodes and 720 cathode conductors, i.e. 818 outputs to be controlled each by a different electric circuit. This is to be compared with a screen such as could be designed by a practioner of ordinary skill (FIGS. 1 and 2), i.e. 575 grids and 3×720 cathode conductors, i.e. 2735 outputs to be controlled, each by a different electric circuit.

At a given instant, all the electrons emitted are either repelled to a grid or have an energy below the threshold cathodoluminescence energy of the luminescent material, or are attracted by a luminescent phosphor in a given primary color. The lateral electron emission of the microtips 14 consequently produces no diaphony phenomenon characterized by a dilution of the colors.

The invention can also apply to microtip monochromatic fluorescent screens. The screen is subdivided into k zones $Z_i$, i ranging between 1 and k and the N rows are grouped into N/k families. The rows (grids 16) of the same family are electrically interconnected. Each zone Zi only comprises a single row of each family. The rows 16 of each family succeed one another within a zone $Z_i$.

FIG. 9 diagrammatically shows part of a monochromatic screen according to the invention. The screen is seen through the second, diagrammatically shown, transparent substrate 22. On the latter are located N conductive bands 26, which are electrically connected by groups of N/k bands 26 to form k anodes $A_i$: one anode $A_i$ per zone $Z_i$. Anodes $A_i$ are covered by a luminescent material 31, e.g. ZnS.

In the same way as for a trichromatic screen, the bands 26 face grids 16 (rows). The grids 16 intersect the cathode conductors 12 (not shown in FIG. 9). Grids 16 and cathode conductors 20 are separated by an insulating layer 16 (not shown in FIG. 9). Each intersection of a row (grid 16) and a column (cathode conductor 12) forms a pixel.

The section of such a monochromatic screen along an axis of a conductive band 26 is identical to the section of a trichromatic screen shown in FIG. 3B, the luminescent material 31 replacing material 28. A single luminescent material 31 is deposited on each conductive band 26.

Example of a Process for Addressing a Monochromatic Screen According to the Invention (FIGS. 10A–10D)

The timing diagrams relating to this addressing process are diagrammatically shown in FIGS. 10A–10D. They relate to the "illumination" of pixel ijl located at the intersection of the row of family $G_j$ in zone $Z_i$ with the cathode conductor (column) of number l in the matrix.

A frame of a picture is displayed for a frame time T. The anodes $A_i$, i ranging between 1 and k, are successively addressed during an addressing time $t_Z$. The addressing of an anode $A_i$ consists of raising the potential $V_{Ai}$ supplied to said anode to the value $V_{Amax}$ during the addressing time $t_Z$. The potential $V_{Amax}$ is such that it attracts the electrons optionally emitted by the microtip 14 with an energy exceeding the threshold cathodoluminescence energy of the material 31. Outside the addressing time $t_Z$, the potential $V_{Ai}$ is maintained at a value $V_{Amin}$ such that the electrons emitted by the microtips are repelled towards a grid 16 or have an energy below the threshold cathodoluminescence energy of the luminescent material.

A family of rows $G_j$ is periodically addressed during a row selection time t. The potential $V_{Gj}$ supplied to the family of rows $G_j$ then assumes the value $V_{Gmax}$ during t at period $t_Z$. The different families of rows are successively addressed during the period $t_Z$. Potential $V_{Gmax}$ permits the emission of electrons. Outside the row selection time, $V_{Gj}$ assumes the value $V_{Gmin}$ not permitting the emission of electrons.

During the addressing time t of the row of the family $G_j$ in zone $Z_i$, potential $V_{Cl}$ applied to the cathode conductor of number l assumes a value $V_{Cmin}$ for the "illumination" of pixel ijl and a value $V_{Cmax}$ if the pixel must remain "extinguished". Thus, $V_{Cmin}$ is such that the potential difference $V_{Gmax}-V_{Cmin}$ is adequate for tearing away electrons at the microtips, whereas $V_{Gmax}-V_{Cmax}$ is not.

An example of numerical data relating to this addressing process is as follows:

N: number of rows 500 k: number of zones 20

T: frame time 20 ms $t_Z$: addressing time of an anode $A_i$=1 ms t: row selection time 40 μs $V_{Ai}$: addressing potential of anode $A_i$: $V_{Amax}$=100 V, $V_{Amin}$=40 V $V_{Gi}$: addressing potential of a family of rows $G_j$: $V_{Gmax}$=40 V, $V_{Gmin}$=−40 V $V_{Cl}$: control potential of column l: $V_{Cmax}$=0 V, $V_{Cmin}$=−40 V.

This type of monochromatic screen only requires N/k addressing circuits for families of rows, k addressing circuits for the anodes and obviously M control circuits for the cathode conductors (for a screen with M columns). However, a microtip monochromatic fluorescent screen according to the prior art requires N addressing circuits for the rows and M addressing circuits for the column, so that the reduction in circuitry is significant.

For producing a family of rows which are electrically connected to one another and for producing an anode (formed by electrically interconnected conductive bands 26), it is e.g. possible to etch in a conductive material parallel bands of appropriate dimensions. The different bands of each family of rows or each anode are electrically interconnected via an anisotropic conductive film electrically contacted with a metal ribbon or tape. This film is only conductive at certain crushing points located on the bands to be connected. The conductive crushing points are interconnected by the metal ribbon.

I claim:

1. A matrix display microtip fluorescent screen having a first insulating substrate (10) on which are arranged in the two directions of a matrix, M conductive columns (12) (cathode conductors) supporting metal microtips (14) and above the columns, N perforated conductive rows (16) (grids), the rows and columns being separated by an insulating layer (18) having apertures permitting the passage of microtips (14), each intersection of a row and a column corresponding to a pixel, said screen being subdivided into k zones $Z_i$, i ranging from 1 to k, with N/k successive rows (16) each, the N rows (16) of the screen being grouped into N/k families of rows, a zone $Z_i$, only having a single row (16) of each family, the rows (16) of the different families alternating within a zone $Z_i$, the rows (16) of a same family being electrically interconnected and on a second transparent substrate (22) facing the first substrate (10), each zone $Z_i$ comprises a family of anodes covered by at least one luminescent material, the families of the different zones being electrically independent and identical, each family of one zone $Z_i$, facing N/k rows of the zone $Z_i$; said screen comprising N/k connections of rows, M connections of columns, x*k connections of anodes, x corresponding to an anode number of each family of said anodes, the selection of a row belonging to zone $Z_i$ of said screen is allowed by applying to said x anodes of this zone a potential greater than said potentials of the columns and by applying to said rows belonging to said same family than said row having to be selected and distributed in each zone, a potential greater than said potential applied to said columns, said different families of rows and said different families of anodes being respectively, successively selected by applying said appropriate potentials.

2. The matrix display microtip fluorescent screen according to claim 1, wherein each family of anodes of a zone $Z_i$ comprises first, second and third series of N/k conductive bands, each, the bands of the different series alternately succeeding one another, the bands of said first series being covered by a material (28) luminescing as red, the bands of said second series being covered by a material (29) luminescing as green and the bands of said third series being covered by a material (30) luminescing as blue, each triplet formed by three bands (26) respectively covered by materials (28, 29, 30) luminescing red, green and blue being substantially aligned facing a row (16) (grid), the bands (26) of each series in a zone Zi being electrically interconnected for forming first, second and third anodes.

3. Process for addressing a microtip fluorescent screen according to claim 2, the display of a trichromatic frame of the image taking place during a frame time T, characterized in that, for the display of a trichromatic frame, it comprises carrying out the following operations for each of the zones Zi, i ranging between 1 and k in a successive manner:

successively raising the families of rows to a potential VGmax for the row selection time t, such that t=T/N, when they are not raised to the potential VGmax, the families of rows are raised to the potential VGmin, such that the microtips do not emit electrons; during the selection time t of each row (16) of the zone Zi in question, successively raising the anodes A1,i, A2,i and A3,i respectively to potentials VA1max, VA2max and VA3max, which are adequate for attracting the electrons optionally emitted by the microdots with an energy higher than the threshold cathodoluminescence energy of the corresponding luminescent materials (28, 29, 30), during addressing times respectively t1, t2 and t3, such that t1+t2+t3=t, when they are not raised to the potentials VA1max, VA2max and VA3max, the anodes A1,i, A2,i and A3,i are raised to the potentials VA1min, VA2min and VA3min respectively, such that the electrons emitted by the microtips are repelled or have an energy below the threshold cathodoluminescence energy of the corresponding luminescent material; and during the addressing times t1, t2 and t3 of each anode A1,i, A2,i and A3,i, addressing the cathode conductors (12) so as to "illuminate" the pixels of the row which should be illuminated.

4. A matrix display microdot fluorescent screen according to claim 1, wherein each family of anodes of a zone $Z_i$ comprises a series of conductive bands (26) covered by a luminescent material (31), each conductive band (26) being substantially aligned facing a row (16) (grid), the conductive bands (26) of a zone $Z_i$ being electrically interconnected to form an anode.

5. Process for addressing a microtip fluorescent screen according to claim 4, the display of a frame of the picture taking place during a frame time T, characterized in that it comprises, for displaying a frame of the screen, carrying out the following operations:

successively raising each of the anodes Ai, i ranging between 1 and k, to a potential VAmax for an addressing time tZ, such that T=ktZ, when they are not raised to an adequate potential VAmax for attracting the electrons possibly emitted by the microdots (14), the anodes Ai are raised to a potential VAmin, such that the electrons emitted by the microtips (14) are repelled, or have an energy below the threshold cathodoluminescence energy of the luminescent material;

during the addressing time tZ of each anode Ai, successively raising each family of rows to a potential VGmax for a row selection time t, such that t=T/N, when they are not raised to the potential VGmax, the families of rows are raised to a potential VGmin, such that the microdots (14) do not emit electrons; and during the row selection time t of each family of rows, addressing the cathode conductors (12) in such a way as to "illuminate" the pixels of each row which should be illuminated.

6. A process for addressing a microtip fluorescent screen, a display of a trichromatic frame of a picture taking place during a frame time T, comprising the following steps: performing the following operations for anodes $A_{1,i}$, i ranging between 1 and k successively and repeating these operations for anodes $A_{2,i}$, and then $A_{3,i}$, so as to display during a frame time T three monochromatic images in three primary colors red, green and blue:

successively raising each of the anodes of a zone $Z_i$, i ranging between 1 and k, to a respective maximum potential adequate for attracting electrons possibly emitted by microtips with an energy higher than a cathodoluminescence threshold of the corresponding luminescent material (28, 29, 30) for respective addressing times $t_1$, $t_2$ and $t_3$ periodically at a period corresponding to a frame time T, such that $(T=k(t_1+t_2+t_3)$, when the respective anodes are not raised to the respective maximum potential, the anodes are raised to a respective minimum potential such that the electrons emitted by the microtips (14) are repelled or have an energy below the cathodoluminescence threshold energy of the corresponding luminescent material;

for the respective addressing of time of each anode, successively raising the different families of rows to a potential $V_{Gmax}$ for respective row selection times $O_1$, $O_2$ and $O_3$ such that $T=N(O_1+O_2+O_3)$ when they are not raised to the potential $V_{Gmax}$, the different families of rows are raised to the potential $V_{Gmin}$ such that the microtips (14) emit no electrons; and during the respective row selection times of each row (16) of each zone $Z_i$, addressing the cathode conductors (12) in such a way as to "illuminate" the pixels of the row which should be illuminated.

* * * * *